US005318125A

United States Patent [19]

Wittrisch

[11] Patent Number: 5,318,125

[45] Date of Patent: Jun. 7, 1994

[54] METHOD FOR CONTINUING MEASUREMENTS AFTER RECOVERY OF A MEASURING TOOL IMMOBILIZED IN A WELL

[75] Inventor: Christian Wittrisch, Rueil Malmaison, France

[73] Assignee: Institut Francais du Petrole, Rueil Malmaison, France

[21] Appl. No.: 988,121

[22] PCT Filed: Jun. 10, 1992

[86] PCT No.: PCT/FR92/00523

§ 371 Date: Apr. 8, 1993

§ 102(e) Date: Apr. 8, 1993

[87] PCT Pub. No.: WO92/22728

PCT Pub. Date: Dec. 23, 1992

[30] Foreign Application Priority Data

Jun. 11, 1991 [FR] France ..... 91 07201

[51] Int. Cl.[5] ..... E21B 47/00; E21B 31/00

[52] U.S. Cl. ..... 166/277; 166/50; 166/250; 166/301

[58] Field of Search ..... 166/277, 301, 250, 50

[56] References Cited

U.S. PATENT DOCUMENTS

| | | | |
|---|---|---|---|
| 4,023,847 | 5/1977 | Webb | 294/86.3 |
| 4,597,440 | 7/1986 | Pottier | 166/250 |
| 4,678,038 | 7/1987 | Rankin | 166/301 |
| 4,945,987 | 8/1990 | Wittrisch | 166/250 |
| 5,042,297 | 8/1991 | Lessi | 166/250 X |
| 5,111,880 | 5/1992 | Wittrisch et al. | 166/250 |
| 5,180,011 | 1/1993 | Wittrisch et al. | 166/250 |
| 5,217,072 | 6/1993 | Wittrisch | 166/250 |

FOREIGN PATENT DOCUMENTS

| | | |
|---|---|---|
| 2609105 | 7/1988 | France . |
| 2094865 | 9/1982 | United Kingdom . |

*Primary Examiner*—Hoang C. Dang

*Attorney, Agent, or Firm*—Antonelli, Terry, Stout & Kraus

[57] ABSTRACT

A method for continuing a measuring operation using a sonde immobilized in the well which method involves lowering, concentric to the cable, a length of tubular elements until the sonde is engaged by a special coupling fitted at the end of the length of tubular elements, the length of tubular elements serving to protect the cable. In addition, a coupling at an upper end of the length of tubular elements is equipped with a lateral window to minimize maneuvering time. After engagement, the sonde is used to carry out measurements by displacing the length of tubular elements.

11 Claims, 8 Drawing Sheets

10
9
5
6
8
7
4
2
26
3
1
25

10
30
12
14
5
6
11
3
1

30
10
13
7
9
7
5
6
12
4
3
1

10
27
28
5
6
26
1
17
3

METHOD FOR CONTINUING MEASUREMENTS AFTER RECOVERY OF A MEASURING TOOL IMMOBILIZED IN A WELL

FIELD OF THE INVENTION

The present invention relates to a method for continuing measurements which have been interrupted or which have not started yet, when the measuring sonde is immobilized in a well into which it has been lowered at the end of a maneuvering and measure transmission cable.

BACKGROUND OF THE INVENTION

There are several well-known methods for trying to grapple a measuring sonde whose handling is no longer possible through the cable, but none allows measurements to be continued at the place where they have been stopped following the immobilization of the sonde or its sticking.

A first method is common to all operations for fishing tubular parts stuck or lost in a wellbore. The well is first cleared of the measuring cable so that it does not hinder later operations. To that effect, the cable is pulled until it breaks at the brittle point which is located on the fixing device on the upper part of the sonde. After taking up the cable by means of its winch, a fishing string mainly consisting of an "overshot", as it is commonly called in the profession, adapted to clutch the top of the sonde, is run down into the well. The other components are conventionally pipes and drill collars. In this method, the difficulty consists of covering the sonde with the overshot in the absence of guiding and while groping along from the surface. This operation may actually only succeed at a slight depth and in instances where the drill hole is well calibrated and where the axis of the tubular to be fished is almost parallel to the axis of the well. Concerning measuring sondes, most of them have a small diameter with respect to the hole and these conditions are scarcely present, except in small-diameter boreholes.

The most common method is called the "cut and thread" method. It consists of cutting the cable at the level of the derrick floor without dropping the part of the cable linked with the sonde into the well. Thus, the two ends of the cut cable are provided with two half-elements constituting a quick coupling. Assemblage of the overshot and of the first drill collars is started in the derrick. The end of the cable connected to the winch is passed through these first elements when they hang on the pipe hook. The two ends of the cable are connected through the quick coupling. The cable may then be maintained taut by its winch while the overshot and the first pipes are lowered around the latter into the well. After hanging them onto the rotary table, the cable is maintained before the quick coupling is opened so as to pass the end of the cable connected to the winch through new tubular elements assembled and hung on the pipe hook, as previously. The lowering maneuver is continued by repeating this operation until the overshot, guided by the coaxial cable, covers and clutches the top of the sonde. The fishing operation is ended, as in the previous method, after the cable has been broken.

This operation is long because passing the cable through each assembled length of tubular elements causes a waste of time which is relatively considerable in relation to the usual maneuver time. In case of sticking in a borehole, it is an accepted fact that speed is a preponderant factor for the success of the fishing operation.

None of the two methods described above allows measurements to be achieved or continued with the sonde in said well.

The method in accordance with the present invention reduces the maneuver time by limiting the number of operations for running the cable through the length of tubular elements, by using advantageously a side-entry sub.

With the "cut and thread method", the sonde is never connected electrically to the surface and it has never been attempted to keep the use of the sensors of the sonde once the latter is stuck. In fact, the use of a quick coupling including sealed connections for the conductors is of no interest here since the cable will be broken after the sonde has been clutched. Furthermore, the cable being coaxial to the string of tubular elements over its total length, it is not possible to move the sonde while keeping the entire cable continuity.

The method of the invention also has the advantage of allowing measurements to be continued when the sonde has been clutched, be it towards the bottom of the well or higher up towards the surface. The measuring operation, which has been interrupted or made impossible by the immobilization of the sonde, will not be totally missed since it is now possible, with the present method, to carry out the total or at least part of the measuring program.

Besides the main advantage cited above, the invention provides a means for knowing precisely the moment of contact of the grappling sub with the head of the sonde, then for checking the holding back of the sonde by said sub. In fact, the sonde is completely operational since it is connected mechanically and electrically to the surface installation, as at the beginning of the operation. By means of sensors and through the transmission of the signals towards the surface, the operator may control that the displacement of the string makes the sonde move identically. This advantage guarantees not only that further measurements will be possible, but also that grappling of the sonde will succeed, unlike prior methods which provide no reliable information on the quality of the grappling of the sonde, which accounts for the relatively high failure rate in the most difficult cases.

Another method called "side door" method may also illustrate the prior art. It consists of using a special overshot having a lateral opening allowing the measuring cable to be passed outside the fishing string. The cable needs not be cut. The string may then be lowered in a conventional way. The overshot is guided onto the head of the sonde as in the "cut and thread" method, then the operation is continued according to the same methodology. This "side door" method is not used for wells deeper than 1,000 meters because it involves high risks of damage of the cable upon lowering of the string towards the well bottom, and in case of cable breakage, the absence of guiding of the overshot most often compromises recovery of the sonde. In fact, when the overshot gets close to the head of the immobilized or stuck sonde, the well will, by that fact, give rise to considerable friction on the end of the string outside which the cable is located and is therefore very vulnerable. Moreover, the mechanical actions necessary to grapple the sonde are most often exceed the strength of conventional cables. In order to make the limited use of this method quite clear, the following recommendation, given to sonde fishing operators, may be cited: "the side door method should not be used to fish tools in open holes, but rather to fish tools stuck at the shoe of a casing string". But when measuring tools are at this level, measurements are generally finished.

SUMMARY OF THE INVENTION

The method of the present invention allows operations in deep, difficult, deflected wells, and also in open holes, because the cable is only present in the annulus defined by the tubular elements and the well at a depth chosen by the operator, where he knows that the cable does not risk any damage. The cable is thus protected against outer friction over a determined length with the method. The protection corresponds to the length of the string between the grappling sub and the side-entry sub.

According to its claims, the present invention thus provides a method allowing measurements to be continued by means of a measuring sonde immobilized in a well, said sonde being connected to the surface by a cable comprising at least one conductor connecting electrically said sonde to a surface control installation, and said cable may be operated by means of a winch.

The invention comprises the following stages :

- cutting the cable substantially above the level of the rotary table,
- fixing a half-connector on each of the two ends of the cut cable, said half-connectors being adapted to constitute a quick coupling for assembling the two ends of said cable,
- lowering into the well a tubular string for grappling the immobilized sonde, said string comprising, in its inner channel, a the lower length of the cable substantially taut between said sonde and the derrick floor, said string comprising at least one grappling sub adapted to grapple said sonde and a determined, length of maneuvering tubulars elements,
- fixing a side-entry sub onto the upper end of said determined length of tubular elements, said sub being adapted to pass said lower cable length from the inside to the outside of the tubular elements, connecting outside the string the two ends of the cable and connecting said conductors of said cable,
- adding, above said sub, the corresponding length of tubular elements to reach the sonde immobilized in the well, while keeping said cable substantially taut,
- guiding the string by means of the coaxial cable so as to grapple the sonde by way of said grappling sub,
- carrying out measurements or servicings with said sonde grappled through said grappling sub to the lower part of said string and linked to the surface by said cable.

The method of the invention allows makes it possible to select the determined length of tubular elements contained between the grappling sub and said side-entry sub substantially equal to a length of mechanical protection of said cable, adapted both to reach the sonde with said grappling sub and to perform displacements during the continuation of the measurements without damaging the cable.

With the previous method, measurements may be carried out with said grappled sonde while going deeper than the depth of immobilization of said sonde, by adding tubulars elements to the upper part of the string. Measurements may also be achieved with said grappled sonde while going higher than the depth of immobilization, by disassembling at most the length of tubulars located above said side-entry sub, while keeping said cable substantially taut.

The method may allow circulation of the drilling fluid by pumping through the grappling string, the side-entry sub comprising seal means around the passage of the cable between the inside and the outside of said string.

The invention may provide a method for detecting the grappling of the sonde through said overshot by means of the surface control installation connected to the sonde by said conductors of said cable.

A mechanical quick coupling comprising means for connecting said electric conductors of said cable may also be used.

The method in accordance with the invention may allow the cable to be broken at the brittle point located at the top of the sonde and to be taken up by means of the winch. The sonde is taken up to the surface by the operation of pull-out of the string.

The previous method and all its variants may be used in oil wellbores, deflected or not with respect to the vertical, in which a measuring or a servicing sonde connected to the surface by a cable comprising at least one electric conductor is immobilized. Said sonde cannot reach the zones of said oil well in which measurements or servicings are performed by action on the cable.

One particular application may be characterized in that the sonde is immobilized by sticking in the well.

Another advantageous application may be characterized in that the sonde cannot reach measurement or servicing zones because of the too high inclination of the well with respect to the vertical, which does not allow descent of said sonde by gravity.

BRIEF DESCRIPTION OF THE DRAWINGS

Other features and advantages of the present invention will be clear from reading the description hereafter given by way of non limitative examples, with reference to the accompanying drawings, in which.

DESCRIPTION OF THE PREFERRED EMBODIMENTS

Figure 1A:
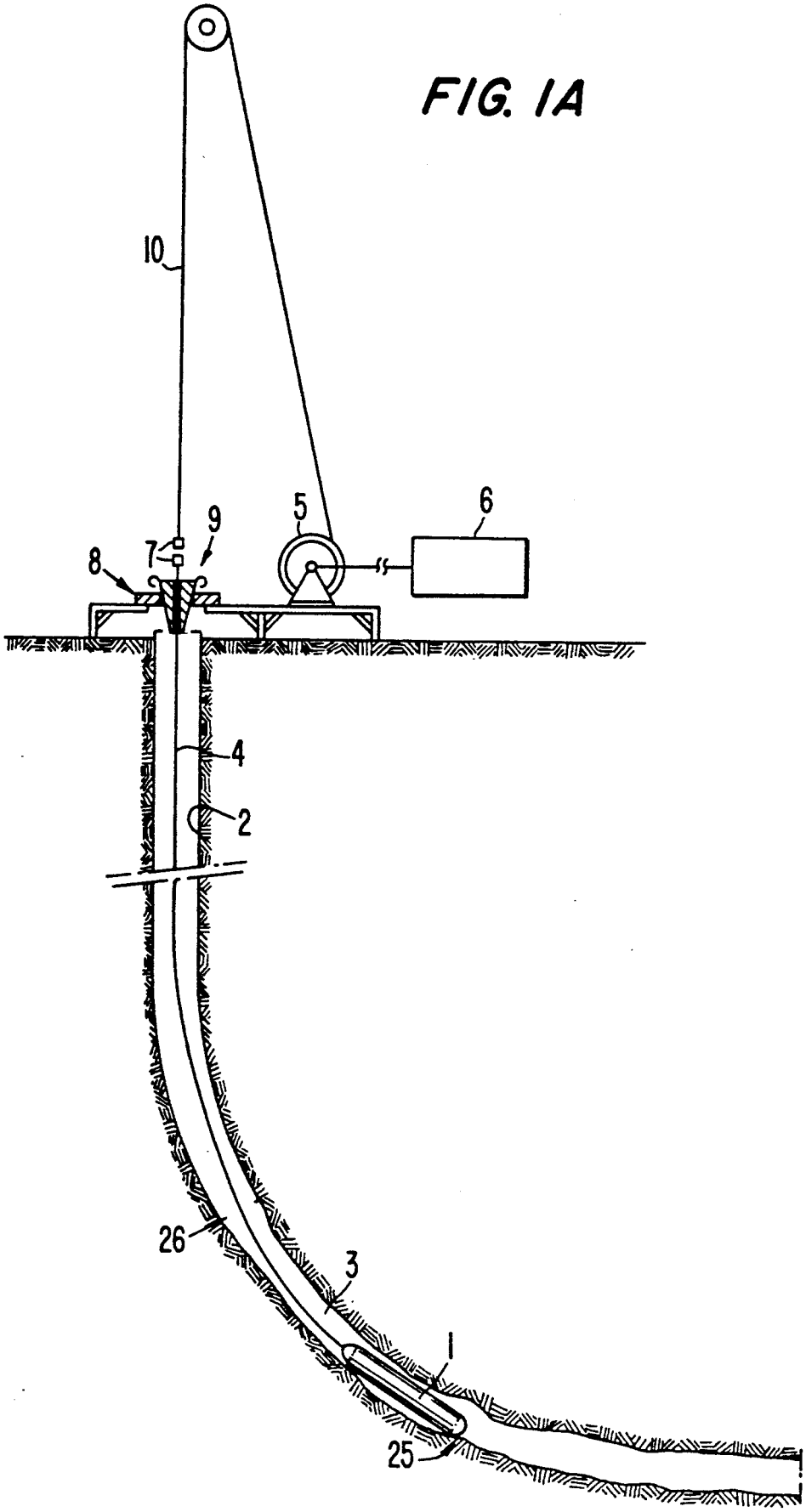
FIGS. 1A, 1B, 1C, 1D and 1E illustrate various stages of the grappling of the sonde with the method of the invention.

FIG. 1A shows a well comprising a cased length 2 and an open hole length 3. A measuring or servicing sonde is immobilized in the open-hole section at a depth 25. The sonde has been lowered into the well by means of cable 4 operated through winch 5 located at the surface. The cable comprises conductors which connect electrically the sonde 1 to a control installation 6.

In the following description of the present invention, the term depth will refer to the length of the well measured from a fixed reference point located at the surface. It is generally the rotary table, but it may also notably be measured from the ground or from the seafloor. The change of the measurement reference point will have no effect on the description and the scope of the invention.

Also, without departing from the scope of this invention, the sonde may be immobilized at a depth where the well is cased, and similarly, the well may have no cased length yet.

In the invention, the sonde operated through cable 4 may be stuck mechanically in the well in such a way that it cannot be taken up to the surface or down towards the well bottom. Without departing from the scope of the invention, the sonde may be prevented from being displaced in only one direction, be it towards the surface or towards the bottom. This may be due to a partial mechanical sticking or to the fact that the well inclination is such that the action of gravity is no longer sufficient to allow descent of the sonde hanging on the end of cable 4. In this case, the sonde is immobilized when friction on the sonde becomes stronger than the force of gravity acting on the sonde. The immobilization depth may then be either the depth from which the sonde can no longer go down towards the well bottom, or a lower depth located above the latter, because the operator preferably chooses, in this case, to set the method of the invention into action with a sonde which is not laid on the walls of the well, but which hangs on the cable. To that effect, he pulls on the cable so as to take the sonde up to a determined depth.

In all the cases cited previously, the section of cable 4 connected to sonde 1 is supported by a conventional jaw device 9 set at the level of a rotary table 8 of the derrick floor. The cable is cut substantially above table 8 and two half-connectors 7 are fastened onto each end. The quick coupling constituted by the two half-connectors is of a conventional type comparable to those used for the "cut and thread" method. Without departing from the scope of this invention, a specific quick coupling comprising means for connecting cable conductors may be used. This specific coupling may be, for example, a quick plug-in socket capable of supporting the weight of the cable while connecting electrically the sonde to installation 6, or more simply a quick mechanical coupling which also allows the conductors to be connected to one another. But, advantageously, the electric connections are only achieved when indispensable, that is when the side-entry sub is set on the string.

After the stage illustrated by FIG. 1A, the operators assemble the first tubular elements of the grappling string above the rotary table. When the latter are still hanging on the lifting hook, the cable end 10 connected to the winch is then passed through these first elements, then the two ends of the cable are linked by connecting the two half-connectors 7. Quick coupling 14 is constituted thereby.

Figure 1B:
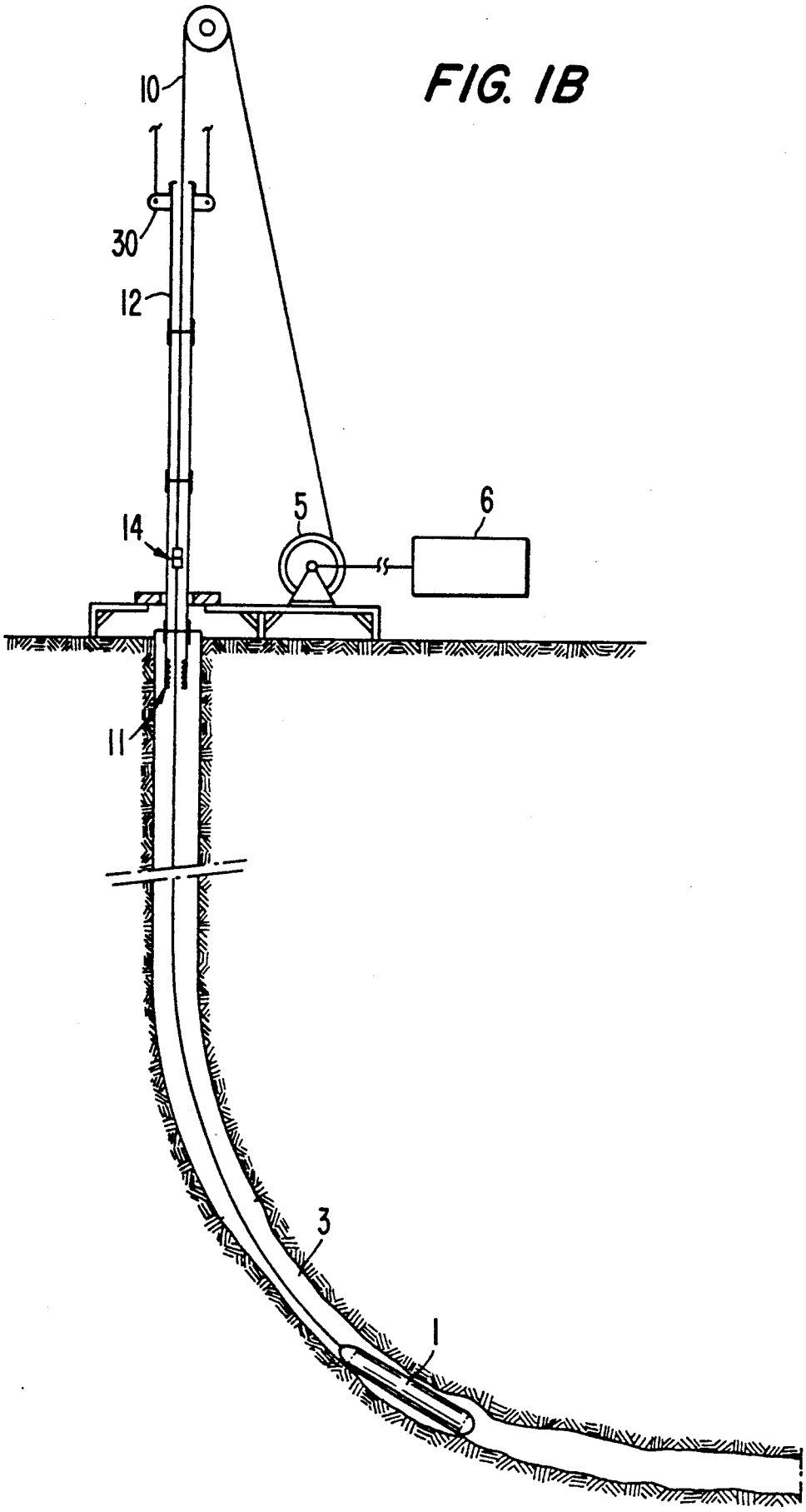

FIG. 1B shows the stage where the first string elements 12 hang on elevators 30 and comprise at their end the grappling sub 11 adapted to co-operate with the head of the immobilized measuring sonde. Quick coupling 14 being assembled, cable 4 is tightened through an action on winch 5. The means 9 for hanging the cable are removed. The driller lowers elements 12 into the well while keeping cable 4, located inside elements 12, substantially taut. The driller hangs them on the rotary table with the conventional means used in the profession. It should be noted that cable 4 and consequently quick coupling 14 are stationary with respect to the rotary table and that elements 12 are lowered concentrically to said cable.

Figure 1C:
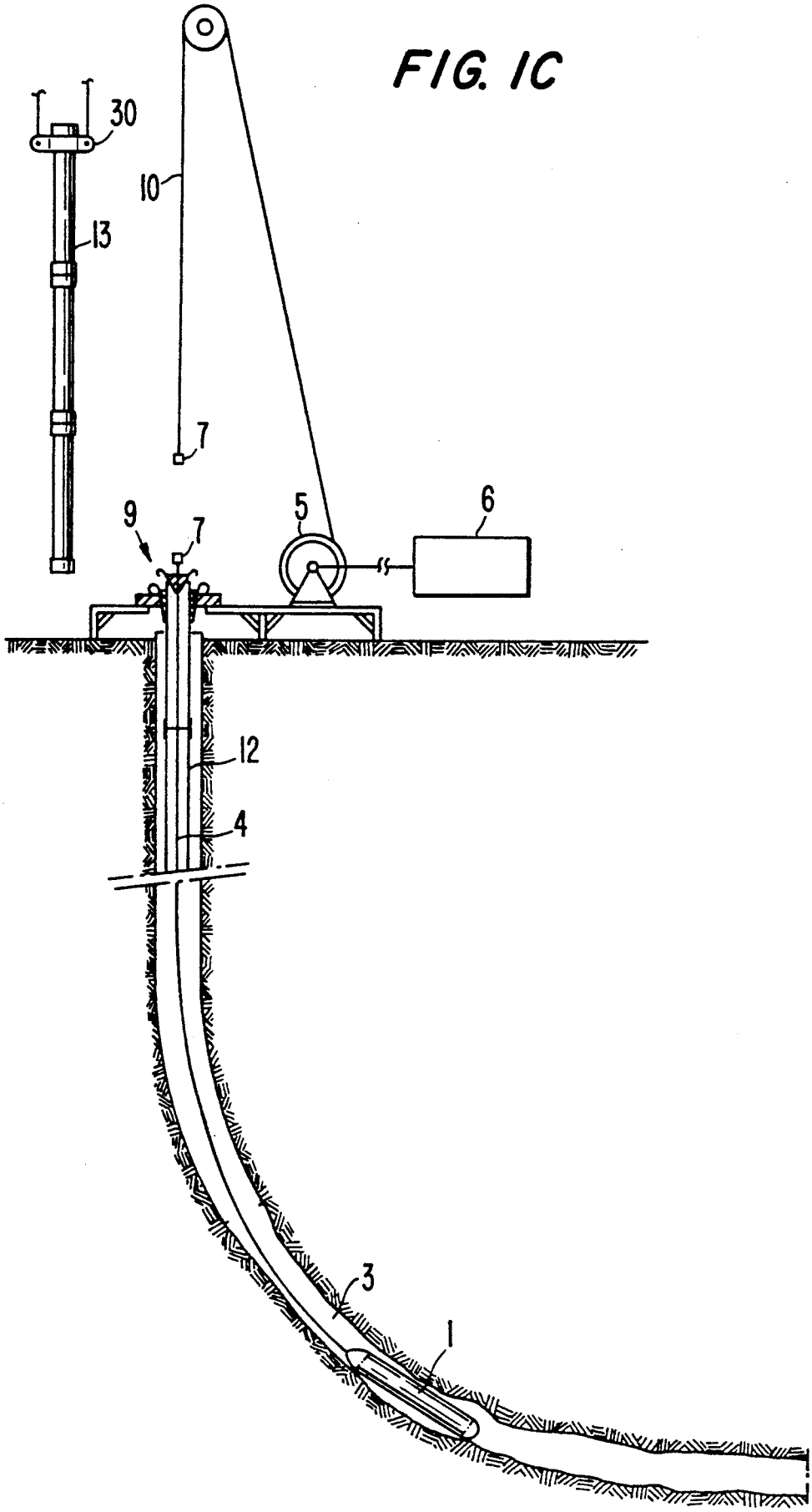

In FIG. 1C, the hanging means 9 are placed on the cable and the quick coupling may then be disconnected.

Figure 1D:
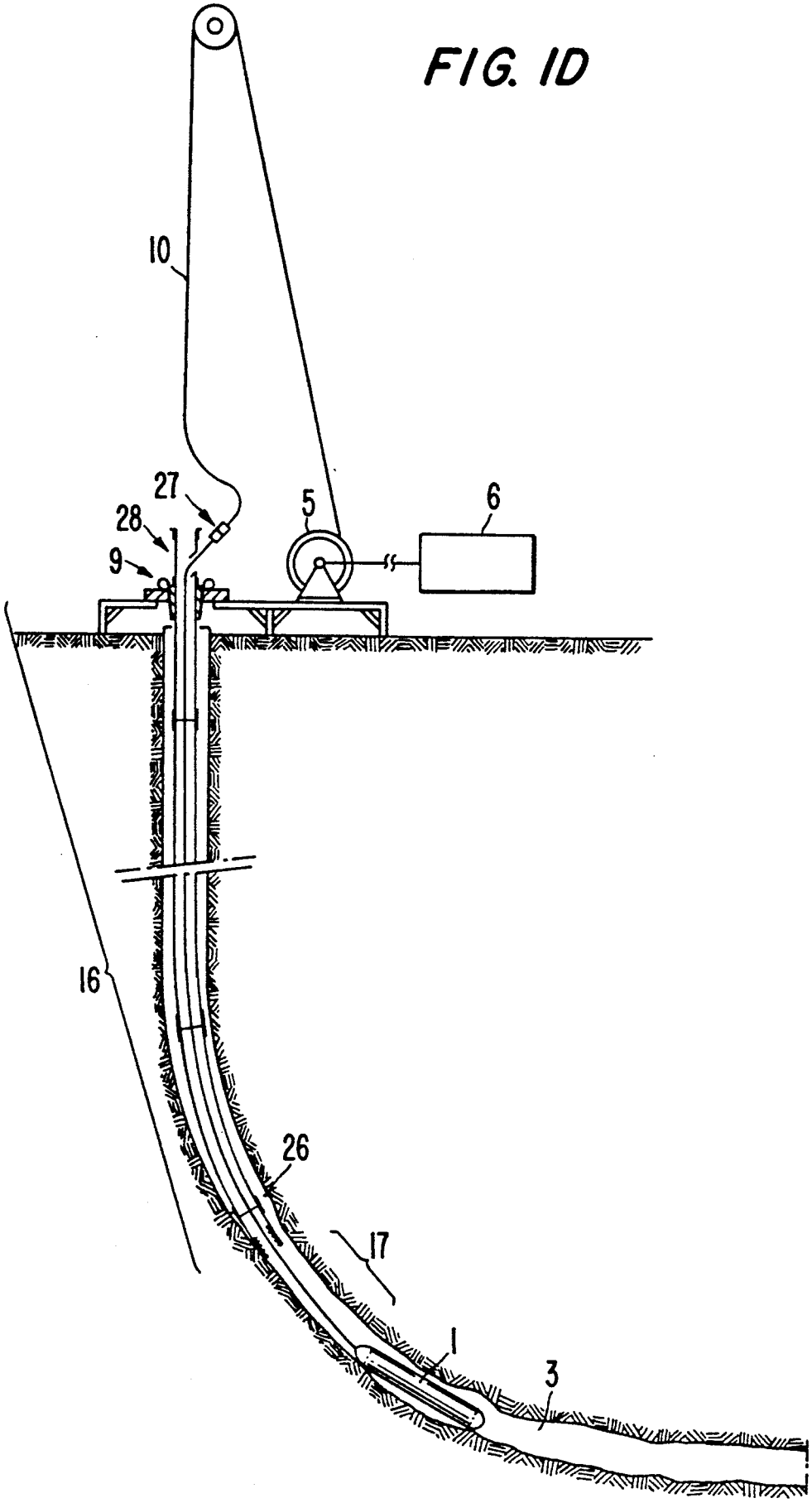

The operators repeat the previous operations by passing the end of part 10 of the cable through another length 13 of tubular elements. After connection of the cable, the latter is tightened again, hanger 9 is removed and element 13 is screwed onto element 12. The assembly is lowered into the well and hung onto the table thereafter. These operations follow one another until the desired string length including the cable in its inner channel is constituted. This length 16 is shown in FIG. 1D.

A side-entry sub 28 is screwed onto the upper end of the determined length 16. This device is adapted notably for three main functions:

- passing a cable from the inner channel of a tubular element towards the outside thereof,
- forming a seal around the cable at the level of the window allowing the previous function,
- letting the cable free to slide in the window, at least in the direction of sliding from the inside towards the outside, that is when the cable is pulled by means of the winch.

Such a side-entry sub is well-known and may be illustrated notably by documents FR-2,502,236 or U.S. Pat. No. 4,607,693.

The end of the part of cable 4 connected to the sonde is passed through the opening of the side-entry of said sub and connected mechanically and electrically to part 10 by means of a connector 27. This coupling restores the electric continuity of the conductors of the cable, it has to be drilling mud-tight and withstand a traction at least higher than the tensile strength of the cable. Without departing from the scope of this invention, a quick coupling 14 respecting the conditions stated for special coupling 27 may be used.

One operational difficulty then consists of screwing the side-entry sub when the cable is passed through the opening of the window. In fact, it is recommended to avoid applying torsions and frictions onto the cable. This is why it may be advantageous to use a side-entry sub device such as that illustrated in FIG. 3.

Figure 3:
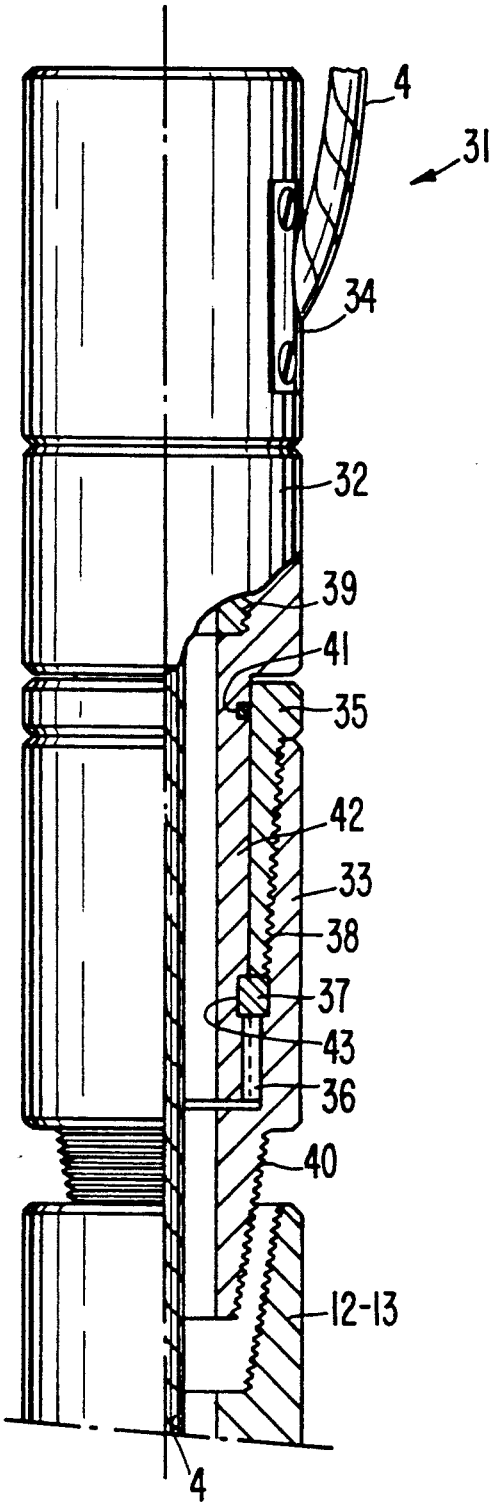
FIG. 3 shows an embodiment of a side-entry sub.

FIG.3 shows a sub referred to as a "three-part" sub. Element 31 is the side-entry sub proper, comprising a side entry 34 provided with a sealing system and with a device for possibly fastening the cable. This sub is screwed through a thread 39 onto another sub 32 comprising a screwing ring 35. This ring rotates freely around the cylindrical extension 42 of sub 32. A device 37 holds ring 35 in a fixed longitudinal position with respect to sub 32. This device may be constituted from a circular ring in two parts screwed radially in a groove 43 machined in extension 42. This device will be dimensioned so as to support the weight hanging on the ring by means of thread 38. A sealing system 41 completes the assemblage of the ring on the extension.

The lower third sub 33 co-operates with a lower string of tubular elements through its thread 40. An antirotation system 36 fastens sub 33 angularly with respect to sub 32.

Mounting of this three-part sub is achieved as follows:

- screwing the lower sub 33 on the top of the tubular string of tubular elements hanging on the rotary table. The cable is kept coaxial,
- elements 31 and 32 are previously screwed and locked by thread 39,
- the cable being held on sub 33 by hanger 9, the free end is passed through opening 34 and connector 27 is assembled. The weight of the cable may then be controlled through winch 5, hanger 9 is removed,
- placing assembly 31 and 32 onto sub 33 while making keying 36 coincide, rotating ring 35 so as to screw the assembly 31 and 32 onto sub 33, without rotating the assembly with respect to sub 33. It should be noted that the antirotation system 36 must have a sufficient length and longitudinal play so as to be able to interlock at the beginning of the screwing operation and to allow the displacement corresponding to the screwing.

Determination of length 16 is important because it represents the wear bushing of the cable between the grappling sub and the side-entry sub.

In the example shown in FIG. D, the operators consider that the cable is in danger if it is in the annulus of the open hole, that is deeper than the shoe 26 of casing 2.

In order to reach the sonde immobilized at a distance 17 from the shoe and for the cable to be protected by the string in the total open-hole section, length 16 must be at least equal to the length 17 which corresponds to the length of the open-hole section between the shoe and the immobilization depth.

If measurements are to be carried out deeper than the immobilization point while keeping the cable protected in the total open-hole section, length 16 must be equal to the length of the open-hole section down to the furthest measurement depth. If the well bottom is to be reached, length 16 must be equal to the total length of the open-hole section.

In the same instance, it is obvious that it will be possible to carry out measurements between immobilization depth 25 and shoe 26 while keeping the cable protected in the total open-hole section, except if the length of casing 2 is shorter than length 17.

Without departing from the scope of this invention, the cable protection length may be different from the length of the open-hole section between the sonde and the shoe of the last casing. In fact, if part of the open hole, under the shoe, is properly calibrated and stable, it may be decided to lower the side-entry sub 28 down to this zone and thus have the cable in the uncased annulus.

It is actually advantageous to limit the length 16 of tubular elements passing around the cable because it is a long and tedious operation. But the risks incurred will have to be assessed.

Conversely, if a casing exhibits sharp bends resulting from deflections provided for example by a side tracking operation, it may then be decided not to lower sub 28 deeper than the side track depth where sticking of the cable through the tubulars can be foreseen. The side tracking operation consists of plugging a well with cement at a certain depth when the drilling operation can no longer be achieved as planned. A window is cut out in the casing, above the plug, and the well is deflected by forming an S-shaped trajectory. This S-shaped trajectory provides considerable friction.

Figure 1E:
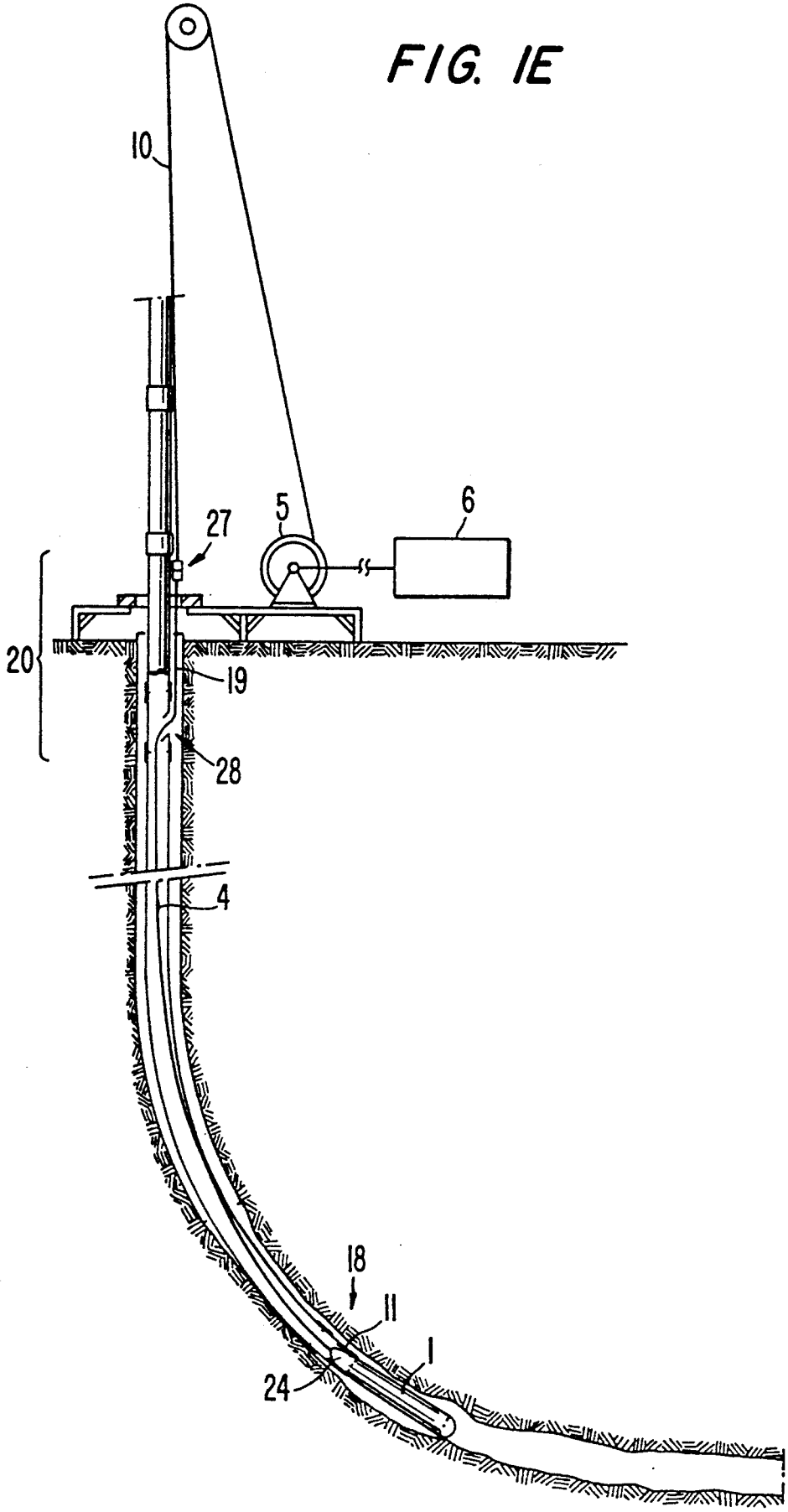

FIG. 1E shows the grappling 18 achieved by the grappling sub 11 on the head of sonde 1. To reach this depth, the operators have assembled the length 20 of tubular tubular elements in a conventional and therefore faster way, without being hindered by a coaxial cable. Cable 4 exhibits a length 19 in the casing-string annulus. During the descent of length 20 of the grappling string, cable 4 is kept taut by means of winch 5. The sonde being still immobilized, the side-entry sub slides along the cable when the tubular string is lowered towards sonde 1.

When they get close to the head of the sonde, operators fasten a circulating head onto the upper part of the string so as to wash the grappling sub through circulation in the string. As it has been mentioned above, the side entry of sub 28 comprises a sealing system.

Gripping of the sonde is achieved through controlled tension on the cable and through the downward motion of the grappling sub. Operators find their way about notably by measurement of the lengths and by the reactions of the sensors of the sonde since the latter remains operational by means of the connections established by connector 27. Grappling may be visualized by control installation 6.

If the sonde is stuck mechanically, it is released according to the usual procedure while having the possibility of controlling the displacement of the sonde.

Figure 2A:
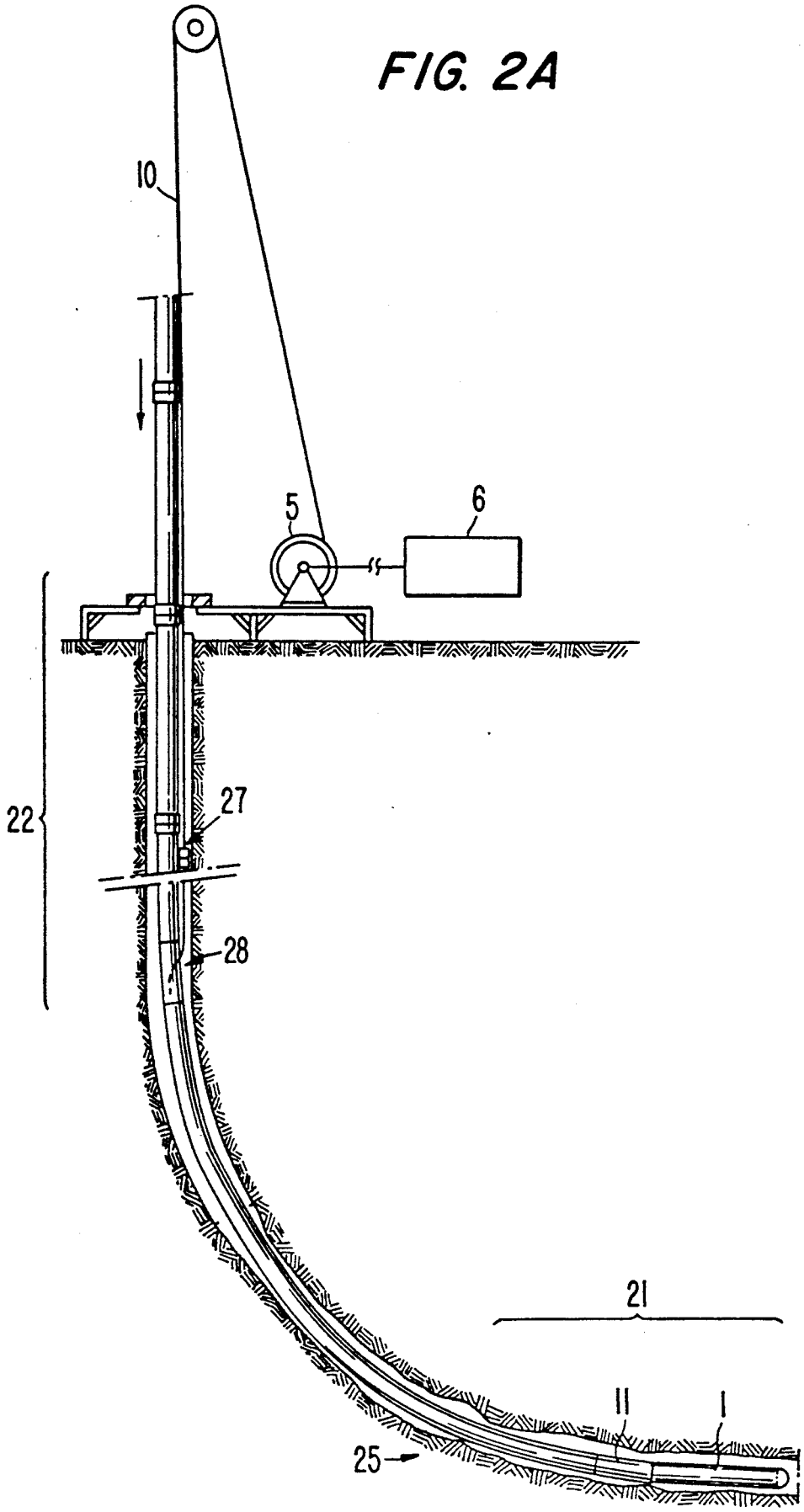
FIGS. 2A and 2B show the measurement operations according to the method of the present invention.
Figure 2B:
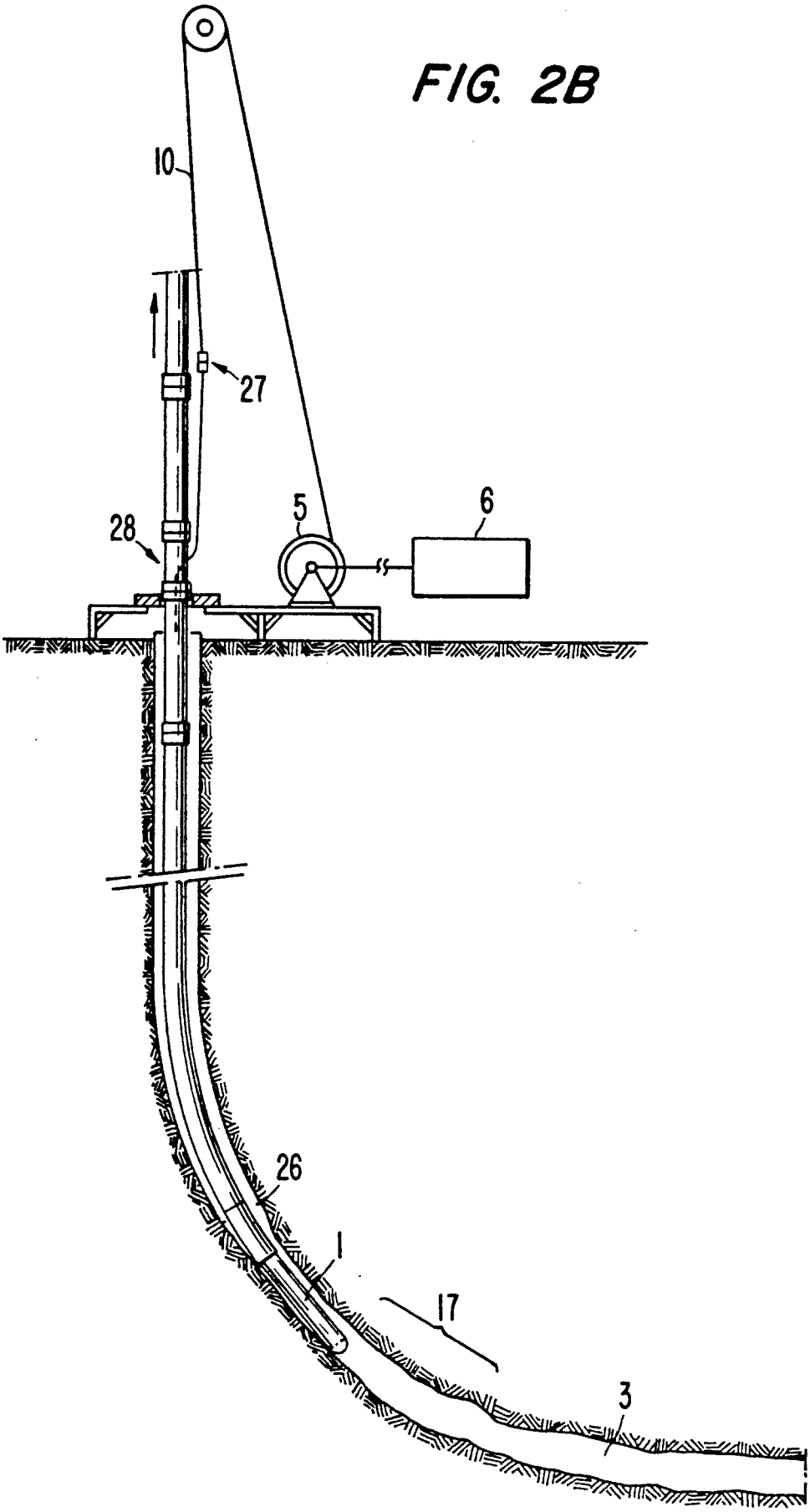

FIG. 2A shows the descent of the sonde deeper below immobilization depth 25 by a length shown here by bracket 21. The string length 22 represents in this case the sum of lengths 20 and 21. Measurements are carried out over this length 21 if need be. If the length 17 of the open-hole section between the immobilization point and shoe 26 is less than or equal to the depth of shoe 26, measurements may also be carried out over length 17.

In all other cases, the maximum upper measurement depth is determined when sub 28 is above ground.

If need be, it remains possible, at this stage of the method, to lower the measuring sonde into the well again so as to complete measurements or to carry out other servicings.

When operations are to be ended, the side-entry sub 28 being above ground, traction is applied onto cable 4 so as to break the brittle point 24 and the cable is entirely taken up through sub 28. When this operation is over, the sonde is taken up to the surface by disassembling the grappling string with the usual care.

Without departing from the scope of this invention, the well may be a complete open hole comprising no casing.

This invention is not limited to servicings in an uncased or a partly cased well. It is actually applicable and very advantageous when the measuring sonde run inside the casings is immobilized notably through the considerable friction provided by bends, deformations or deteriorations in a zone of these casings.

I claim:

1. A method for controlling measurements by means of a measuring sonde immobilized in a well, said sonde being connected to the surface by a cable comprising at least one conductor electrically connecting said sonde to a surface control installation, and said cable being operated by means of a winch, said method comprising the following stages:

cutting the cable above the level of a rotary table of a derrick floor, fixing a half-connector onto each of the two ends of the cut cable, said half-connectors being adapted to constitute a quick coupling for assembling said cable, lowering into the well a tubular string for grappling the immobilized sonde, said string containing in its inner channel a lower length of the cable substantially taut between said sonde and the derrick floor, said string comprising at least one grappling sub adapted for grappling said sonde and a determined length of maneuvering tubular elements, fixing a side-entry sub onto the upper end of said determined length of tubular elements, said sub comprising a side wall passage through which said lower length of cable passes from the inside towards the outside of the tubular elements, connecting outside the string the two ends of the cable and connecting said conductors of said cable, adding above said sub a length of tubular elements adapted to reach the sonde immobilized in the well, while keeping said cable substantially taut, guiding the string by means of said lower length of cable so as to grapple the sonde by way of said grappling sub, carrying out measurements of servicings with said sonde fastened through said grappling sub to the lower part of said string and connected to the surface through said cable.

2. A method as claimed in claim 1, further comprising:

selecting the determined length of tubulars contained between the grappling sub and said side-entry sub substantially equal to a length of mechanical protection of said cable adapted both to reach the sonde with said grappling sub without damaging the cable and for displacements of the sonde during continuation of the measurements.

3. A method as claimed in claim 1 or claim 2, comprising;

carrying out measurements with said grappled sonde while going deeper than the point of immobilization of said sonde by adding tubular elements to an upper part of the string while keeping said cable substantially taut.

4. A method as claimed in claim 1 or claim 2, comprising:

carrying out measurements with said grappled sonde by going higher than the point of immobilization, by disassembling at most the length of tubular elements located above said side-entry sub while keeping said cable substantially taut.

5. A method as claimed in claim 1, further comprising;

circulating the drilling fluid by pumping through the grappling string, the side-entry sub comprising seal means around the passage of the cable between the inside and the outside of said string.

6. A method as claimed in claim 1, further comprising:

detecting the grappling of the sonde by said grappling sub by means of the surface control installation connected to the sonde by said conductors of said cable.

7. A method as claimed in claim 1, further comprising:

using a quick mechanical coupling to connect said cable, comprising means for connecting electric conductors of the cable.

8. A method as claimed in claim 1, further comprising:

breaking the cable at a the brittle point located at the top of the sonde, taking up the cable by means of the winch and taking the sonde up to the surface by the operation of pull-out of the string.

9. Application of the method as claimed in claim 1 or claim 2 to an oil well deflected or not with respect to the vertical and in which a measuring or servicing sonde, connected to the surface by a cable comprising at least one electric conductor, is immobilized, and said sonde cannot reach the measuring or servicing zones of said oil well by action on the cable.

10. Application as claimed in claim 9, wherein the sonde is stuck in said well.

11. Application as claimed in claim 9, wherein the sonde cannot reach the measuring or servicing zones because of the too strong inclination of the well with respect to the vertical, which does not allow cable descent of said sonde by gravity.

* * * * *